United States Patent [19]

Andrews

[11] Patent Number: 4,664,319

[45] Date of Patent: May 12, 1987

[54] RE-ENTRANT CIRCULATING STREAM JET COMMINUTING AND CLASSIFYING MILL

[75] Inventor: Norwood H. Andrews, Moorestown, N.J.

[73] Assignee: Norandy, Incorporated, Moorestown, N.J.

[21] Appl. No.: 653,189

[22] Filed: Sep. 24, 1984

[51] Int. Cl.[4] ..... B02C 19/06
[52] U.S. Cl. ..... 241/39; 241/5
[58] Field of Search ..... 241/5, 39, 40

[56] References Cited

U.S. PATENT DOCUMENTS 4,219,164 8/1980 Taylor ..... 241/39 X

FOREIGN PATENT DOCUMENTS 2520100 3/1976 Fed. Rep. of Germany ..... 241/39

*Primary Examiner*—Mark Rosenbaum
*Attorney, Agent, or Firm*—Seidel, Gonda, Goldhammer & Abbott

[57] ABSTRACT

Improved grinding in a re-entrant jet comminuting and classifying mill is provided by directing the gaseous jet streams emitted from the nozzles in the annular peripheral wall of the mill's vortex chamber at a relatively acute angle to the radius of the chamber and also at an acute angle to the central axis of the chamber whereby the jet streams merge at a tangent circle that is substantially within the midpoint of the radius of the chamber and axially spaced from the plane of the nozzles in a direction remote from the axial outlet of the mill. The mill is provided with axial feed.

8 Claims, 5 Drawing Figures

FIG. 1
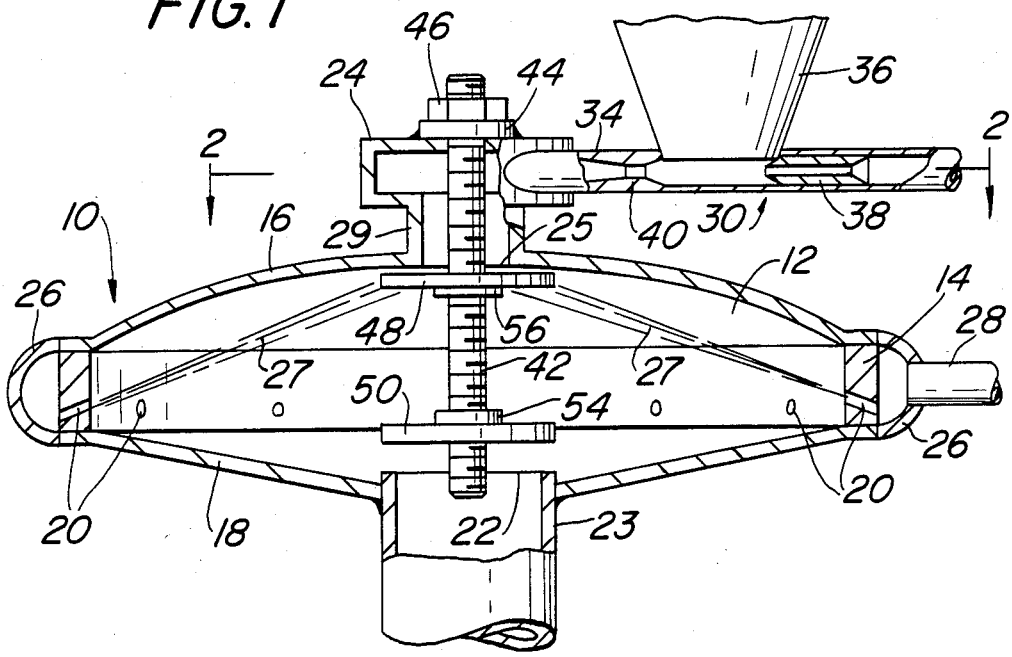
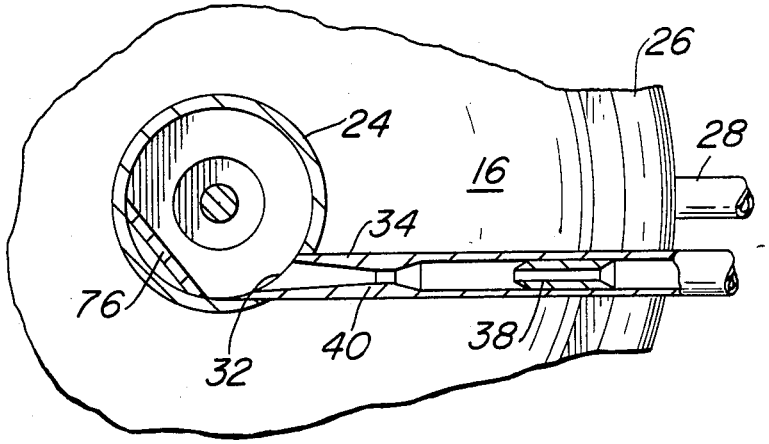
FIG. 2

FIG. 3
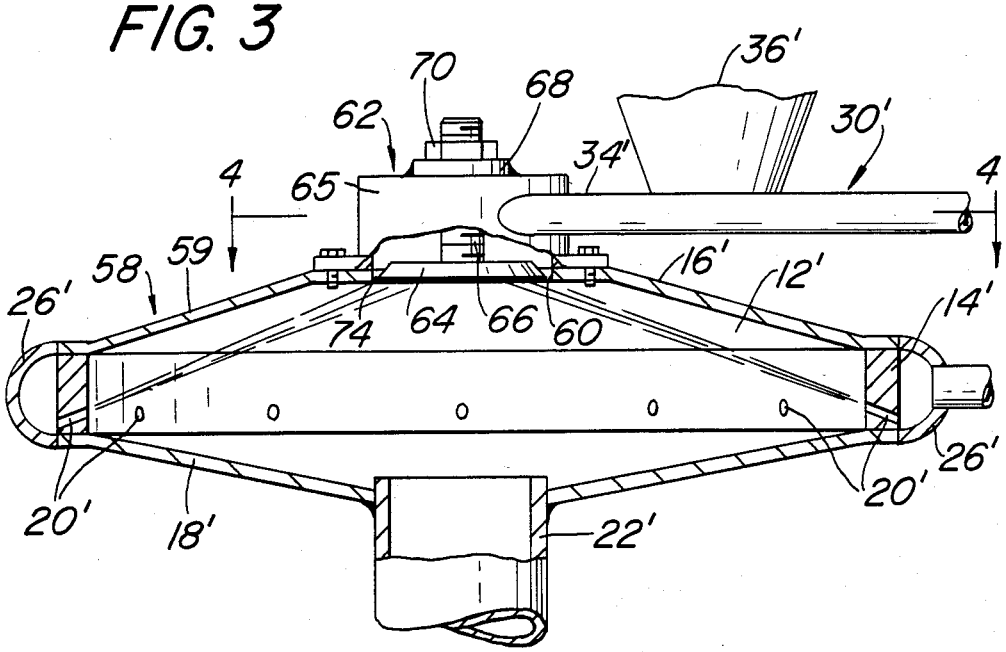
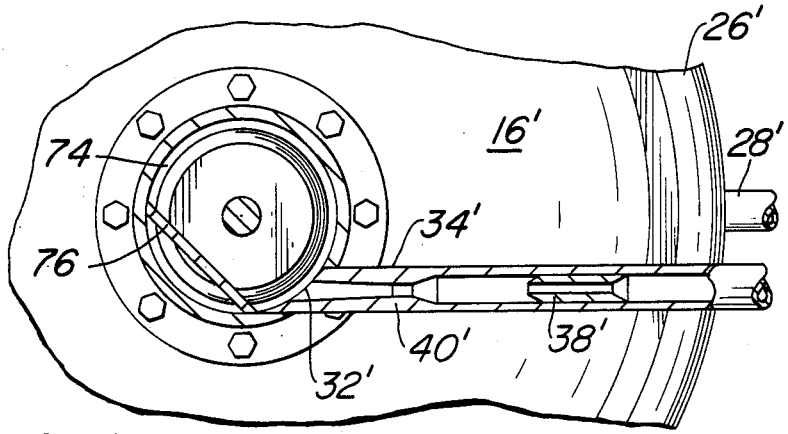
FIG. 4

RE-ENTRANT CIRCULATING STREAM JET COMMINUTING AND CLASSIFYING MILL

BACKGROUND OF THE INVENTION

This invention relates to a re-entrant circulating stream jet comminuting and classifying mill, and more particularly to that type of mill but with the jet streams redirected at an acute angle to the axis of the mill.

The present invention relates to comminuting and classifyng apparatus of the type disclosed in U.S. Pat. No. 2,032,827 issued Mar. 3, 1936 to Norwood H. Andrews for Method And Apparatus For Providing Material In Finely Divided Form. The comminuting principle disclosed in that patent, with various modifications and improvements, is probably the world's most universally used device for extremely fine dry grinding. Because only the energizing gas and the material under reduction moves within the apparatus, proper correlation between the two is critical to successful comminution of various materials. These relationships have been worked out and are known to persons who operate grinding mills of this type.

Since its introduction, there have been many studies of the action in this type of mill (also known as the Micronizer). *Perry's Chemical Engineering Handbook,* 5th Edition, page 43, Section 8, states that "[t]he action in these mills has been studied photographically and mathematically (Rumpf Chem. Ingr.-Tech. 32(3) 129–135, (5) 335–342 (1960) A.T.S. Translations (668 G 844 GJ)."

All of these studies confirm the fact that as material is fed into the mill, the angle of the jet streams discharged from a circular peripheral manifold initiates a rotation of the material in the mill until there is a turbulent circulating band of material through which the jet streams penetrate. Grinding or comminuting is the result of the jet streams entraining some of this circulating material at their discharge ports and projecting it at high velocity through the slower circulating load of material with the impact and attrition doing the grinding.

More grinding is done when the circulating load has considerable radial depth, but the increased mass of the circulating load removes energy from the rotation of the gas leaving less energy to drive the classifying vortex. Therefore a balance has to be maintained between the velocity of the classifying vortex and the amount of material fed into and circulating with the load. Thus, the radial depth and mass of the circulating load cannot be increased beyond certain limits without reducing the angular velocity of the vortex and thereby adversely affecting its ability to classify fine particles.

In the mid-1930's, this inventor had motion pictures taken of the operation of a Micronizer re-entrant circulating stream jet mill viewed through a glass top and bottom wall. These pictures showed that grinding is done as the jets pick up material at the peripheral wall (through aspiration) and project such material against material into the circulating load. These pictures also showed that the jet streams carry a considerable amount of material into the body of the classifying vortex, but very little grinding results from the impact of this projected material with material projected by the other jets in the mill. However, it was observed that struck material particles at the tangent circle, that is the imaginary circle to which all of the jet streams are tangent, more frequently glanced in a generally radial inward direction than axially. These particles probably move in this direction because this is the general component of force of the jet streams as they intersect with each other.

Because of this tendency of the materials to glance radially inward, it has been accepted practice to design re-entrant circulating stream jet comminuting and classifying mills with the tangent circle generally at the midpoint of the radial distance between the peripheral wall and the axial outlet. See, for example, the relative position of the tangent circle in relationship to the collector and peripheral wall in FIG. 2 of U.S. Pat. No. 2,032,827. See also the relative position of the product outlet in FIG. 1 of U.S. Pat. No. 4,056,233. The reason for positioning the tangent circle midway between the peripheral wall and the axial outlet mills is understood by reference to U.S. Pat. No. 2,032,827 at page 6, column 1, lines 59 to 74 which describes the relationship between the grinding zone and the classifying vortex, and is expanded upon in U.S. Pat. No. 4,018,388 at column 1, lines 60 through column 2, line 6. As noted in this latter patent, the tangent circle is kept radially outward from the outlet by a "safety distance factor" so that oversized particles can be returned from the classification zone to the grinding zone by allowing them to gain sufficient centrifugal momentum.

Because of this tendency in re-entrant circulating stream jet mills to project oversized particles into the classifying vortex, the prior art includes a fair amount of literature describing ways to eliminate "kickbacks" (oversized particles) in the final product. See U.S. Pat. No. 2,562,753 at column 1, lines 15 to 25; U.S. Pat. No. 2,690,880 at column 1, lines 15 to 34; U.S. Pat. No. 3,425,638 at column 1, lines 67 to 72; U.S. Pat. No. 3,559,895 at column 2, lines 50 to 60; and U.S. Pat. No. 4,056,233 at column 1, lines 24 to 35. The last mentioned patent specifically incorporates a physical barrier "for inhibiting premature discharge from the mill of those heavier and coarser particles of the material which per chance may have traversed the gaseous vortex without having been reduced to the desired classification size and effecting their re-entry into the vortex to further subject them to the grinding energy of the gaseous fluid until they have been reduced in size by attrition to their desired classification for ultimate discharge from the mill". It is interesting to note that even though the apparatus described in U.S. Pat. No. 4,056,233 positions the nozzles substantially midway between the peripheral wall and the product outlet, it is still considered necessary to incorporate a physical barrier to inhibit the premature discharge of oversized particles.

It is known that grinding in re-entrant circulating stream jet mills can be improved by pointing the jet stream in a more radial direction; that is by positioning the tangent circle nearer the outlet. See U.S. Pat. No. 4,018,388 at column 1, lines 62 to 64. But the above-mentioned "safety distance factor" established the general practice of operating re-entrant circulating stream jet mills by positioning the nozzles to direct their jet streams tangent to a circle substantially midway between the periphery and the outlet.

It is therefore an object of the present invention to provide a more finely ground product in a re-entrant circulating stream jet comminuting mill by redirecting the gaseous fluid jet streams to bring the tangent circle radially closer to the outlet without increasing the quantity of oversize particles in the final product.

SUMMARY OF THE INVENTION

The present invention departs from the long-established practice of directing the jet streams to a tangent circle positioned a safe radial distance from the product outlet. In accordance with the present invention, the nozzles direct the jet streams radially inwardly and at an acute angle to an imaginary plane through their exit port from the peripheral wall of the mill so that in a preferred form of the invention the tangent circle has a diameter equal to or less than the diameter of the axial outlet and it is spaced axially away from the aforesaid plane. One of the advantages of repositioning the tangent circle as thus described is improved grinding by reason of the tangent circle being radially closer to the outlet but without adversely affecting the ability of the classifying vortex to reject unwanted oversized particles.

Because the extra radial distance necessitated by the safety distance factor is no longer necessary, the overall diameter of the mill can be made considerably smaller. In the re-entrant circulating jet stream mill of the present invention, the radial safety distance factor is replaced by a volume of increased axial depth under the path of the jet streams as they merge and form a circulating zone spaced away from the entrance to the central discharge outlet. Assuming other operating factors remain the same, a tangent circle of reduced diameter has a higher angular velocity. This increased angular velocity at the tangent circle determines the size of the material rejected to the periphery for further grinding. This makes possible a finer end product by adjusting other parameters of the mill, such as making its diameter considerably smaller.

Another advantage of the present invention is that the mill can be operated at relatively high gas pressures adjacent the annular peripheral wall. It is known that when the same quantity of gas for a given mill is introduced into a smaller diameter mill, the pressure at the annular peripheral wall increases to the extent that considerable extra energy is required to introduce the material into the mill adjacent the wall. However, the gas pressure near the axis of the mill is less than half that adjacent its periphery. See U.S. Pat. No. 2,032,827 at page 4, second column, lines 60 to 64. In some cases a negative pressure has been observed at the axis of the mill. In accordance with the present invention, a re-entrant circulating stream jet mill can be operated at extremely high peripheral pressures by providing axial feed means that takes advantage of the lower pressure at the central axis of the mill.

The foregoing advantages are provided in a re-entrant circulating stream jet comminuting and classifying mill by directing the gaseous jet streams emitted from the nozzle ports in the mill's peripheral wall to merge at an imaginary tangent circle that is equal to or smaller in diameter than the axially concentric product outlet in one wall of the mill's vortex chamber. Moreover, the tangent circle is positioned axially remote from the product outlet by directing the gaseous jet streams at an angle to an imaginary plane extending through the nozzle exit ports. Such a mill may be operated at relatively high pressures for its diameter. Raw material is fed into the mill without an adverse increase in the amount of energy used to direct raw material to the peripheral wall by a vortical feed apparatus opening into the mill at its axis and directly into the tangent circle.

DESCRIPTION OF THE DRAWINGS

For the purpose of illustrating the invention, there are shown in the drawings a form which is presently preferred; it being understood, however, that this invention is not limited to the precise arrangements and instrumentalities shown.

FIG. 1 is a sectional view of a mill embodying the present invention.

FIG. 2 is a sectional view of the mill taken along the line 2—2 of FIG. 1.

FIG. 3 is a sectional view of a mill embodying an alternate form of the invention.

FIG. 4 is a sectional view taken on the line 4—4 in FIG. 3.

DETAILED DESCRIPTION OF THE INVENTION

Figure 5:
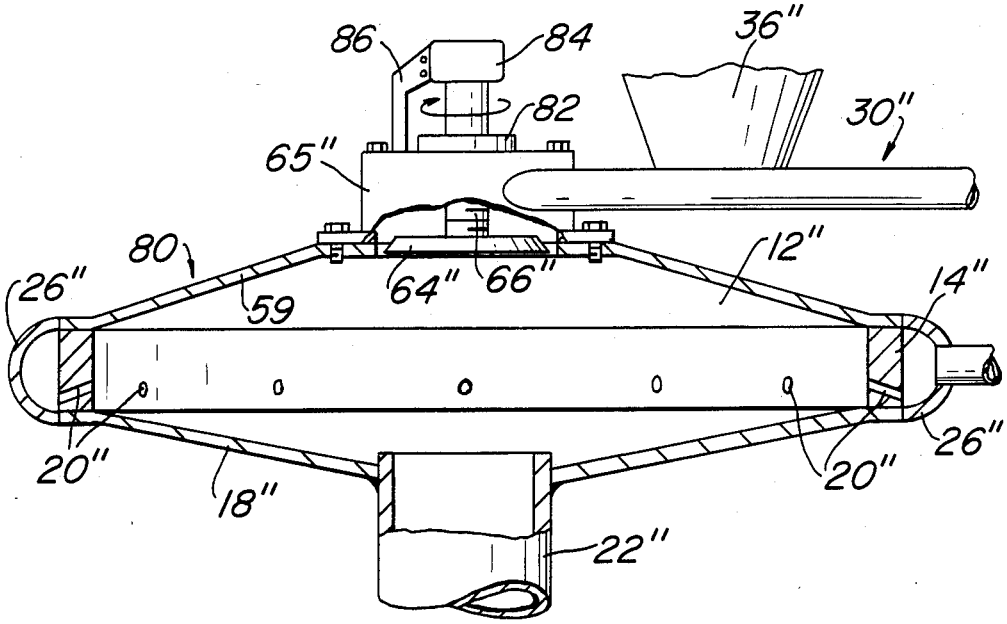
FIG. 5 is a sectional view of a mill embodying an alternate feed means for the mill illustrated in FIGS. 3 and 4.

Referring to the drawings in detail wherein like numerals indicate like elements, there is shown in FIG. 1 a comminuting and classifying mill of the re-entrant circulating stream jet type designated generally as 10.

The re-entrant circulating stream jet mill 10 is generically the type known as a Micronizer and operates in accordance with the principles applicable to such mills except as hereinafter described. The mill 10 includes a circular grinding and classifying chamber 12 (also known as a vortex chamber) defined by the annular peripheral wall 14 and first and second opposed lateral walls 16 and 18. The walls 14, 16 and 18 are preferably held together by C-clamps (not shown) or like devices for ready disassembly and cleaning. As illustrated, the lateral walls 16 and 18 diverge away from each other with the distance of greatest divergence being at the central axis of the chamber 12. Lateral wall 16 is continuously curved in a concave dish shape as viewed from the interior of chamber 12. Lateral wall 18 is conical. Although the foregoing are the preferred shapes for lateral walls 16 and 18, other configurations may be used keeping in mind that one of the functions of lateral wall 16 is to guide feed material and partially ground material back to the annular peripheral wall 14 and into the jet streams being emitted by the nozzles 20 extending through the peripheral wall 14.

The outlet 22 is a cylindrical duct 23 mounted concentric with the axis of the chamber 12 in wall 18. Finished product together with a portion of the fluid gases flowing within the chamber 12 pass through duct 23 to an appropriate collection system. It is not necessary to describe the collection system as it is conventional. As illustrated, the duct 23 extends partly into the chamber 12 to provide a cylindrical wall which forms a barrier against surface creep of waste material on the lateral wall 18 into the outlet 22.

Feed chamber 24, to be described in more detail below, opens into the chamber 12 through inlet 25 at its axis.

Surrounding the annular peripheral wall 14 is an annular manifold 26 connected through the duct 28 to a source of a gaseous fluid (not shown) under pressure such as air or steam.

A plurality of nozzles 20 are spaced at regular intervals around the entire peripheral wall 14. As shown, the exit port of each nozzle is positioned below the mid line of the peripheral wall 14; that is axially closer to the outlet opening 22 than to the inlet opening. As illustrated, each of the exit ports for the nozzles is equidistant from the bottom edge of the peripheral wall 14 so that an imaginary common plane passes through each of them. As explained below, this imaginary plane helps define the direction of the gaseous jet stream emitted by each of the nozzles. In accordance with this invention, these jet streams are not only at an angle to the radius of chamber 12 but also are at an acute angle to the axis of chamber 12. The gas streams 27 are illustrated in FIG. 1.

Each of the nozzles 20 directs a fluid jet stream so that there is both a forward and a radial component of force. Thus, as is known in jet comminuting technology, the nozzles 20 create a circulating vortex within the chamber 16.

Each of the nozzles 20 directs a fluid jet stream at the same angle relative to the radius and axis of the chamber 12. Each of the jet streams is tangent to an imaginary circle (herein called the tangent circle) within the chamber 12 as described in more detail below.

The mill 10 is provided with a vortex feed apparatus which comprises the cylindrical feed chamber 24 closed at one end and opening through duct 29 coaxially into chamber 12.

As best illustrated in FIG. 2, the feed chamber 24 is provided with an inlet 32 positioned in the wall of the chamber in such manner that material fed through the feed duct 34 flows into the chamber 24 tangential with its cylindrical wall. The direction of flow is the same as the direction of flow within the chamber 12. The feed material is fed into the mill 10 from funnel 36 and is entrained by gaseous carrier fluid exiting from the nozzle 38 which injects the material into the venturi passage 40 where it is accelerated and propelled through inlet 32 into the feed chamber 24. The nozzle 38 is connected to a source of carrier fluid under pressure (not shown).

In addition, it may be desirable although not necessary, to provide an anvil 76 forming a chord of the feed chamber 24 opposite the discharge end of the venturi 40 prime. In some cases, it may be desirable to roughen the impact surface of the anvil 76.

A threaded rod extends axially into the chamber 12 through feed chamber 24 and is held in position by fixed nut 44 and lock nut 46. Nut 44 is fixed to the end wall of feed chamber 24 by any appropriate means such as a spot weld. Rod 42 supports discs 48 and 50 within chamber 12 by means of appropriate threaded nuts 52 and 54 which permit the position of discs 48 and 50 to be adjusted as explained below.

For ease of describing the operation of the mill 10, it is useful to use "upper" and "lower" to describe the relationship between parts, such as the lateral walls 16 and 18. However, it should be understood that this is intended only to simplify the description and does not represent a preferred form. The mill 10 will work equally well in any position since gravity, insofar as is understood, does not have any effect on the mill's operation.

By way of example, but not limitation, the mill 10 may include a peripheral wall having an inner wall that is 20 inches in diameter and $1\frac{1}{2}$ inches high. The interior diameter of duct 23 may be 4 to $4\frac{1}{2}$ inches wide, concentric with the peripheral wall and extends approximately $\frac{1}{2}$ inch into the chamber 12. The feed chamber 24 opens into the vortex chamber 12 through a coaxial opening 25 of slightly less diameter than the opening in duct 23.

The disc 48 is positioned so as to essentially cover the inlet except for a small annular opening of approximately $\frac{1}{4}$ inch. The disc 48 is preferably the same diameter as the outlet opening of duct 23. Disc 50 is preferably the same diameter as disc 48.

In accordance with the present invention, the tangent circle created by the jet streams exiting from the nozzles 20 is preferrably equal to or less than the diameter of the outlet 22 and is positioned closely adjacent to the disc 48. Such a tangent circle is created by directing the gaseous fluid jet streams, not only more radially inward than is conventional in existing practice for re-entrant circulating jet stream mills, but also at an acute angle rather than normal to the central axis of the mill 10 and its chamber 12. Another way of describing the same effect is to note that the jet streams are directed at an angle to the imaginary common plane which extends through all of the exit ports for the nozzles 20 in the peripheral wall 14. This results in the tangent circle being positioned not only radially inward compared to prior practice but also axially more remote from the finished product outlet in the lower lateral wall 18.

Axially feeding re-entrant circulating stream jet mills is not new. It is shown in FIG. 29 of U.S. Pat. No. 2,032,827 and is described and illustrated in U.S. Pat. No. 4,018,388. However, it is novel to introduce the feed material into the central portion of the vortex resulting from the jet streams merging at a relatively small diameter tangent circle. Not only does this require less energy to introduce the feed material into the mill, it also immediately mixes the feed material with material being projected upwardly and radially inwardly by the jet streams to form a highly turbulent primary sorting zone. The dish shaped lateral wall 16 combined with the high angular velocity of the material at the tangent circle forces the heavier and larger particles outwardly and directs them to the peripheral wall where they are aspirated into the jet streams for further grinding. The finer and lighter fractions soon lose their initial outward velocity and are gradually entrained in the more streamlined vortical inward flow in the portion of the vortex below the tangent circle. Although there is no physical barrier dividing the vortex, there is a partial dynamic barrier dividing it into two loosely defined zones. The upper zone (i.e. the zone more axially remote from the outlet) is a highly turbulent primary sorting zone created by the relatively smaller diameter tangent circle. The lower zone is a streamlined vortex which carries the finer and lighter fractions out of the chamber 12. The barrier itself is the result of the several high speed jet streams expanding through the entire radial distance of the vortex in an angular direction with respect to the aforementioned plane of the nozzles.

As indicated above, raw material is fed tangentially into the circular chamber 24. Consequently, there is a continuing rotation of the material around the inner wall of the chamber. This results in some of the circulating feed material impacting upon feed material first being introduced into the chamber 24. Thus providing some initial grinding effect.

A mill like the one illustrated in FIG. 1, but without axial feed, was constructed and tested. This mill was provided with 10 nozzles (including the feeding nozzle) 9/32 inches in diameter. The air at 1,000 cubic feet per minute was introduced into the mill through the nozzles. This is approximately twice the quantity of air recommended for operation of this type of mill as indicated in the brochure entitled "The Micron-Master Jet Pulverizer" published by the Jet Pulverizer Company, Route 73, Palmyra, N.J. 08065. The Micron-Master is a reentrant circulating stream jet mill which has been in use for approximately 30 years. Ordinarily air at 1,000 cubic feet per minute would be used in a mill 24 inches in diameter. However, by using axial feed with a respositioned tangent circle as described above, the circular material load moves at a higher angular velocity. This is believed to be due in part to the reduced frictional forces resulting from the shortened circumference of the peripheral wall relative to the energy input.

Tests on this mill established that increased feed rates up to $1\frac{1}{2}$ to 2 times that of conventional micronizers produced comparable products. On the other hand, at comparable feed rates, a much finer product was produced.

From the foregoing description, it is apparent that when a greater quantity of material is circulating in a smaller diameter mill of the same peripheral height, the radial depth of the circulating load will be greater. As a result, the peripheral jets, which load themselves at the exit ports of the nozzles, drive the material through a greater depth of circulating material resulting in substantially finer grinding.

The nozzles in the mill 10 were directed to a 3 inch tangent circle inclined upwardly about 12° from a plane through their exit ports in the peripheral wall. Obviously, the inner axial dimension of the chamber 12 was increased to accommodate the greater volume of gas.

The major function of the disc 48 is to close the inlet so that gas and material in the jet streams does not flow into the feed chamber 24. The disc 48, on the other hand, is spaced from the lateral wall 16 sufficiently to allow for the flow of feed material into the chamber 12. Preferably the gaseous jet streams are directed to impinge on the disc 48.

The precise function of the disc 50 is not fully understood. It is known, however, that it does help improve the quality of the product. Its exact axial position is determined empirically depending upon the type of material being ground. In one example it was placed $1\frac{3}{4}$ inches from the outlet 22.

Referring now to FIGS. 3 and 4, there is shown another embodiment of the present invention. Specifically, FIGS. 3 and 4 illustrate a modified form of the re-entrant circulating steam jet mill of the present invention designated 58. This mill includes a modified feed mechanism 60 as described hereinafter.

Only the parts of mill 58 which differ from the mill 10 are described in detail. Those parts of the mill 58 which are the same are indicated by the same number but with a prime associated therewith. Except where necessary for purposes of clarity, parts and their function already described will not again be specifically referred to.

As illustrated, lateral wall 59 is conical.

An inlet 60 coaxial with the axis of the chamber 12' is provided in the wall 16'. A feed mechanism 62 is mounted over the inlet 60 and includes a cylindrical feed chamber 65 which functions in the same manner as the feed chamber 24 in the embodiment of the invention illustrated in FIGS. 1 and 2. The inlet 60 is closed by a disc 64 supported by a threaded rod 66 bolted to the end wall of feed chamber 64 by fixed nut 68 and lock nut 70. Disc 64 is smaller in diameter than inlet 60 so as to provide a narrow annular opening up to 3/16 inch into the chamber 12'. Feed material flows through this annular opening 74 into the interior of chamber 12'. The annular opening is adjacent to tangent circle formed by the gaseous streams emitted from the nozzles 20'.

This method of feeding material is essentially the same as described in FIG. 4 of copending patent application Ser. No. 502,383 filed June 8, 1983 for Method and Apparatus For Comminuting Materials To Extremely Fine Size Using a Circulating Steam Jet Mill and A Discrete But Interconnected And Interdependent Rotating Anvil-Jet Impact Mill now U.S. Pat. No. 4,504,017 issued Mar. 12, 1985, and assigned to the same assignee as this patent application. It should be noted, however, that the mill illustrated in FIGS. 3 and 4 of this application functions differently than the mill described in the co-pending patent application by reason of the reduced diameter of the tangent circle and angle of the jet. FIG. 4 of the copending application shows and describes a mill of higher axial displacement than conventional mills because of the greater quality of gas leaving the micronizer section combined with the gas introduced by the reinjection nozzle. Moreover, the feed nozzle aspirates gas along with the feed material. Such a mill is roughly estimated to carry twice the volume of gas in the microsizer section as compared to a conventional microsizer of substantially the same diameter.

The mill 58 illustrated in FIG. 3 operates in the same manner as the mill illustrated in FIGS. 1 and 2 except the inner diameter of the inlet 60 is 6 inches with the disc 64 being slightly less than that at approximately 53/16 inches.

Referring now to FIG. 5, there is shown a re-entrant circulating stream jet comminuting and classifying mill 80 which is similar in all respects to the mill 58 illustrated in FIGS. 3 and 4 except as hereinafter described. Accordingly, like parts are marked with like numerals except they are double primed. Such parts will not be referred to except as is necessary to clearly describe this embodiment of the invention.

As shown, the disc 64'' is fixed to the end of the rod 66''. The rod 66'' extends through a stuffing box 82 and is connected to the shaft of the electric motor 84. Motor 84 is supported on the end wall of chamber 65''.

Motor 84 drives disc 64'' in the same direction as material flow and vortical flow in chamber 80. The high speed rotary action of spinning disc 64'' reduces the accumulation of compacted feed material on its surface as occurs with some materials.

It should be apparent from the foregoing that there has been described a re-entrant circulating stream jet comminuting and classifying mill that operates according to novel principles. Prior mills functioned with a turbulent vortical zone radially outward of the tangent circle and a streamlined vortical zone radially inward of the tangent circle. The present invention departs from the foregoing by repositioning the tangent circle and hence also the turbulent zone and the streamline zone. In accordance with the principles of the present invention, the turbulent zone is positioned not only radially outwardly of the tangent circle but also in a zone that is radially inward of the tangent circle but axially displaced from the plane of the nozzle exit ports in the peripheral wall. This is accomplished by directing the gaseous jet steams to a relatively small diameter tangent circle adjacent the inlet that is, in the upper portion of the mill as illustrated in FIGS. 1 through 5. On the other hand, the steamlined zone is now positioned in the inner and axially lower portion of the mill.

The advantages accomplished by such redirection of the gaseous jet streams and hence repositioning of the tangent circle include increased angular, velocity at the tangent circle. This permits the coarser materials to be driven back to the peripheral wall without an adverse increase in energy. Another advantage is that the coarse material rejected outwardly from the tangent circle will be concentrated along the upper lateral wall, such as the wall 16. This reduces the probability of random oversize particles passing, by deflection or otherwise, through the aforementioned dynamic barrier and into the inner and lower streamlined classification zone. Still further, the use of axial feed apparatus as illustrated permits the feed and rejected material to return to the peripheral jets as a concentrated stream of material rather than as an infinite number of discrete particles. This concentration of material improves the manner in which the jets act on the circulating load.

As noted above, the exit ports for the nozzles 20, 20' and 20'' are preferably positioned in the lower portion of the peripheral wall. In this manner, material will not circulate in the lower corner of the peripheral wall below the jets to the detriment of grinding.

For the purpose of illustrating the invention, there is shown in the drawings a form which is presently preferred; it being understood, however, that this invention is not limited to the precise arrangements and instrumentalities shown.

The present invention may be embodied in other specific forms without departing from the spirit or essential attributes thereof and, accordingly, reference should be made to the appended claims, rather than to the foregoing specification, as indicating the scope of the invention.

I claim:

1. A re-entrant circulating stream jet communiting and classifying mill comprising:

a vortex chamber being formed by an annular peripheral wall and opposed lateral walls;

a vortex chamber having a central axis the spatial distance between said lateral walls along the central axis of the mill being substantially less than the diameter of said annular peripheral wall;

a product outlet positioned about the central axis in one of the lateral walls;

a material feed inlet in the other of said lateral walls a plurality of gaseous fluid nozzles spaced throughout said peripheral wall for discharing gaseous fluid streams through said peripheral wall into said chamber;

each of said nozzles being positioned to discharge the gaseous fluid such that their respective streams have a component of movement forward in the direction of circulation of the gaseous stream within the chamber, a radial component of movement relative to the central axis of said chamber, and a component of movement at an acute angle to the central axis of the chamber to form a circulating vortex in said chamber;

each of said nozzles being positioned to project its gaseous fluid stream to merge tangent to a circle within the chamber, said tangent circle thereby being positioned axially more remote from the lateral wall with the product outlet than the opposing wall, and said tangent circle also thereby being positioned substantially within the mid-point of the radius of the chamber.

2. Apparatus in accordance with claim 1 wherein the diameter of said tangent circle is equal to or less than the diameter of the product outlet.

3. Apparatus in accordance with claims 1 or 2 wherein said inlet opens into said chamber in the other of the said lateral walls at the central axis of said chamber.

4. Apparatus in accordance with claim 3 wherein a disc of approximately the same diameter as said product outlet is positioned adjacent said product inlet and closes said product inlet except for an annular opening.

5. Apparatus in accordance with claim 4 including means to rotate said disc during operation of the mill.

6. Apparatus in accordance with claim 4 including a second disc axially spaced from said first disc toward said product outlet.

7. Apparatus in accordance with claim 4 wherein said tangent circle is at the periphery of said disc.

8. A re-entrant circulating stream jet comminuting and classifying mill in accordance with claim 1 wherein each of said nozzles is positioned to project its gaseous fluid stream to cause material circulating within said mill to impinge upon the lateral wall which is opposite to the lateral wall that includes the product outlet.

* * * * *